US008453988B2

(12) United States Patent
Simpson et al.

(10) Patent No.: US 8,453,988 B2
(45) Date of Patent: Jun. 4, 2013

(54) TRACK CEILING CLIP APPARATUS

(75) Inventors: Jeff Leland Simpson, Fort Collins, CO (US); Kevin P Conway, Lafayette, CO (US); Kraig J Kruger, Boulder, CO (US)

(73) Assignee: SpectraLink Corporation

( * ) Notice: Subject to any disclaimer, the term of this patent is extended or adjusted under 35 U.S.C. 154(b) by 1271 days.

(21) Appl. No.: 11/811,837

(22) Filed: Jun. 12, 2007

(65) Prior Publication Data

US 2008/0308517 A1 Dec. 18, 2008

(51) Int. Cl.
*A47H 1/10* (2006.01)
*A47B 96/06* (2006.01)

(52) U.S. Cl.
USPC ..... 248/317; 248/231.41; 248/228.3; 248/298.1

(58) Field of Classification Search
USPC ..... 248/231.41, 228.3, 228.7, 224.61, 248/222.11, 225.11, 231.8, 292.12, 298.1, 248/316.4, 316.6, 317, 320; 362/404; 211/113
See application file for complete search history.

(56) References Cited

U.S. PATENT DOCUMENTS

| | | | | | |
|---|---|---|---|---|---|
| 2,963,253 | A | * | 12/1960 | Maier et al. | 248/298.1 |
| 2,964,279 | A | * | 12/1960 | Galloway | 248/27.1 |
| 3,018,080 | A | * | 1/1962 | Loudon | 248/228.4 |
| 3,310,911 | A | * | 3/1967 | Boser et al. | 248/27.8 |
| 3,518,421 | A | * | 6/1970 | Cogdill | 248/57 |
| 4,073,458 | A | * | 2/1978 | Sease | 248/340 |
| 4,191,352 | A | * | 3/1980 | Schuplin | 248/317 |
| 4,494,296 | A | * | 1/1985 | Grimes | 29/432 |
| 4,976,633 | A | * | 12/1990 | Beghelli | 439/571 |
| 5,335,890 | A | * | 8/1994 | Pryor et al. | 248/343 |
| 5,806,823 | A | * | 9/1998 | Callas | 248/320 |
| 6,606,887 | B1 | * | 8/2003 | Zimmer et al. | 70/164 |

* cited by examiner

*Primary Examiner* — Tan Le
(74) *Attorney, Agent, or Firm* — Honigman Miller Schwartz and Cohn LLP

(57) ABSTRACT

A track clip hanger assembly is composed of two parts that are mated together in a slidable manner to attach the assembly to a hanging ceiling track. Each of the two track clip hanger parts include an arrangement for mating one part to the other and each of the two parts include an arrangement for attaching the assembly to a ceiling track such that the assembly hangs from the bottom of the track when the two parts are in the mated position and the two parts of the track clip hanger assembly are mated in such a manner that the two parts will not accidentally come apart or un-mate. The track clip hanger assembly is designed to allow an electronic device to be attached to it so that the device can not accidentally become un-attached.

31 Claims, 7 Drawing Sheets

Track Clip Hanger Assembly.
10

Track Clip Hanger Assembly. 10

Track Clip Hanger Assembly 10

Track Clip Hanger Assembly 10

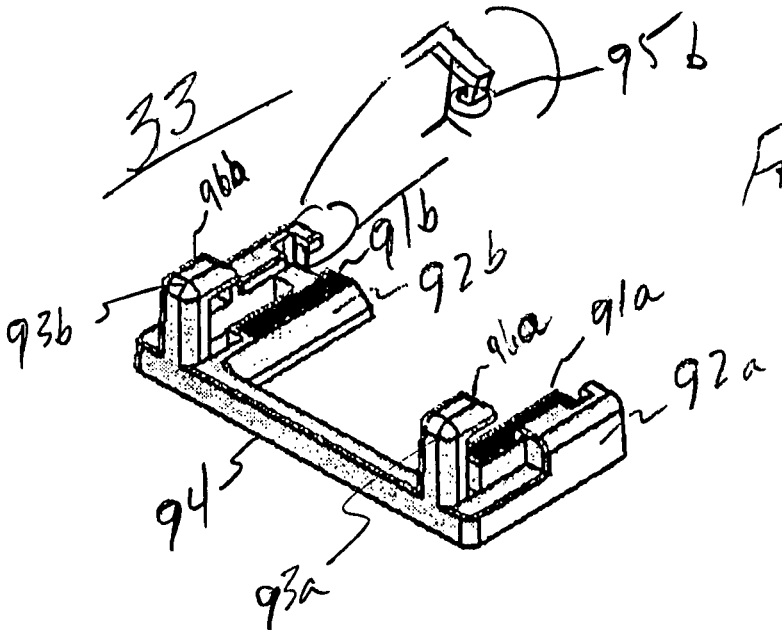
Fig 9
Fig 10
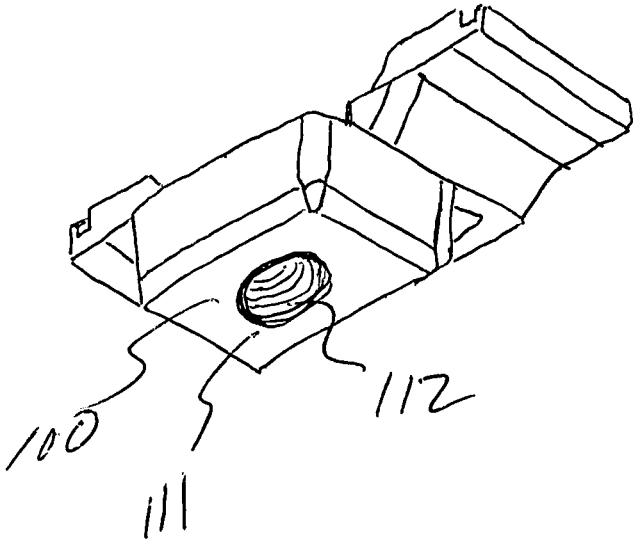

TRACK CEILING CLIP APPARATUS

FIELD OF THE INVENTION

Our invention generally relates to the field of hanger clips that attach to a ceiling from which objects can be mounted and specifically to adjustable hanger clips that can be removably attached to a hanging ceiling to which objects can be easily mounted to hang from the ceiling.

BACKGROUND OF THE INVENTION

Suspended ceilings are prevalent in many industrial and commercial buildings as they permit building systems to be installed above the ceiling and allow for easy access to these systems in the event they need to be serviced. Suspended ceiling systems typically include some sort of inverted "T" shaped metal track on which the ceiling panels rest and are supported. As these metal tracks are relatively rigid, it is convenient to hang various light-weight objects from them. Base stations or access points associated with a wireless LAN are often hung from or mounted to the downward side of the metal tracks of suspended ceilings in order to optimize their effectiveness in the wireless LAN. During or subsequent to the initial installation of the access point into a wireless LAN, it is advantageous to be able to easily mount the access point to the metal track and to be able to easily move the access point around on the metal track from one location to another in order to determine the optimal location from which the access point can operate.

SUMMARY OF THE INVENTION

Preferred embodiments according to the present invention provide a convenient technique for mounting an access point to a metal track using a small, inexpensive, light-weight track clip hanger device that can be quickly and easily attached to the metal track and to which the access point can be quickly and easily mounted. The track clip hanger can be securely attached to the metal track and the access point can in turn be securely mounted to the clip. The track clip hanger was adjustable to be able to fit ceiling tracks of different widths.

In a preferred embodiment the track clip hanger assembly is comprised of two track clip hanger body elements that are attached to the ceiling track at the same time that each of the two body elements are mated with each other. One of the track clip hanger body elements of the preferred embodiment includes a receiver to which the mount of an electronic device can be inserted. In a preferred embodiment each of the track clip hanger body elements includes a body mating element and two ceiling track attachment arms. In a preferred embodiment each of the body mating elements associated with one of the track clip hanger body elements includes a ratcheting element and a body mating registration channel. In a preferred embodiment each of the body mating elements associated with the other one of the track clip hanger body elements includes a ratcheting element and a channel registration element. In alternate embodiments one or both the track clip hanger body elements only include one ceiling track attachment arm. In other embodiments the receiver is configured to receive a screw held captive in the access point or is configured to hold a screw for attaching to the access point.

BRIEF DESCRIPTION OF THE DRAWINGS

FIG. 9 is a perspective drawing of a top view of a second body element comprising the track clip hanger assembly.

FIG. 10 is a perspective drawing of a bottom view of the first body element comprising the track clip hanger assembly.

DETAILED DESCRIPTION OF THE INVENTION

Figure 1:
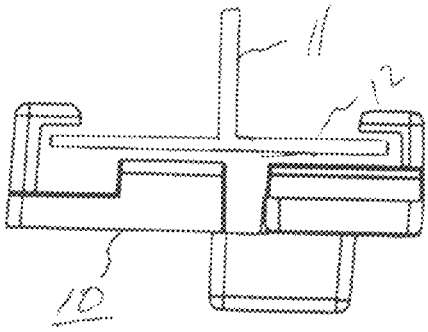
FIG. 1 is a drawing of a track clip hanger assembly attached to a ceiling track.

FIG. 1 is a side view of a track clip hanger (TCH) assembly 10 illustrating how it attaches to a ceiling track 11. The ceiling track is shown in cross section and is typically attached to the ceiling or a structure such that its orientation is that of an inverted "T". The track clip hanger assembly is attached to the horizontal element 12 of the ceiling track and this horizontal element can be of various widths, depending upon aesthetic, ceiling tile support, or other reasons.

Figure 2:
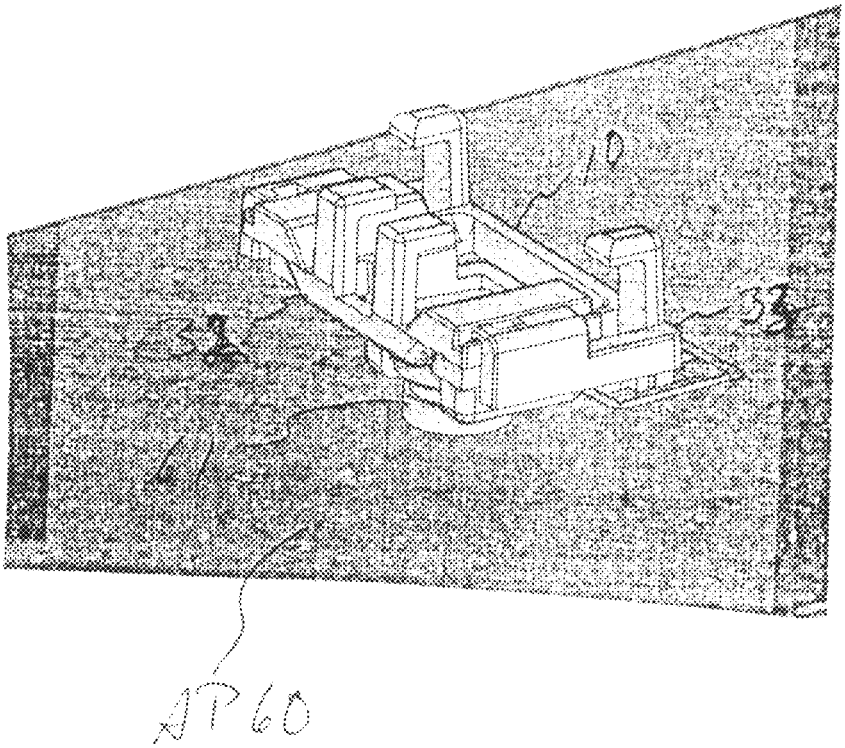
FIG. 2 is perspective drawing of the track clip hanger assembly mounted to an access point showing mated first and second track clip hanger body elements.

FIG. 2 is a perspective drawing of the preferred embodiment of the TCH assembly 10 showing first and second TCH body elements 32 and 33 respectively in a mated position with respect to each other and attached to an access point (AP) mounting element 61 which is in turn attached to the top side of access point 60. While we describe our invention in terms of supporting an electronic device, such as an access point, our TCH assembly 10 can be easily modified to accommodate hanging other electronic or non-electronic items, such as signs, display cards or other objects.

Figure 4:
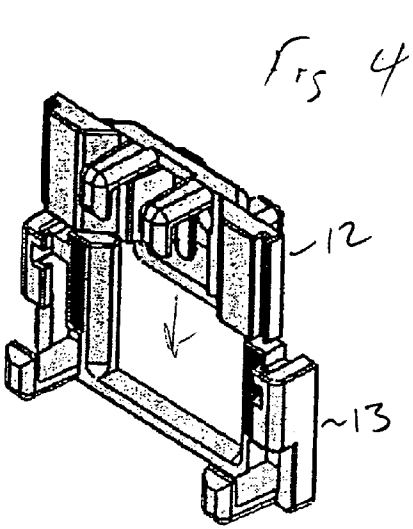
FIG. 4 is a perspective drawing of the top view of the track clip hanger assembly.
Figure 5:
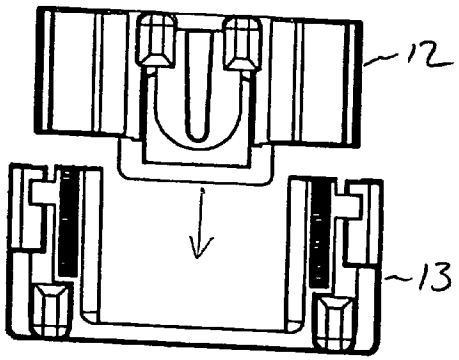
FIG. 5 is a bottom view of the un-mated track clip hanger assembly.
Figure 3:
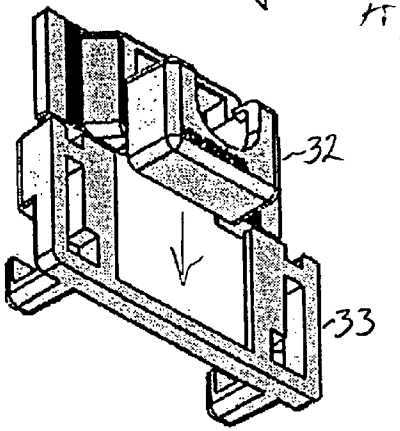
FIG. 3 is a perspective drawing of a bottom view of the track clip hanger assembly.
Figure 6:
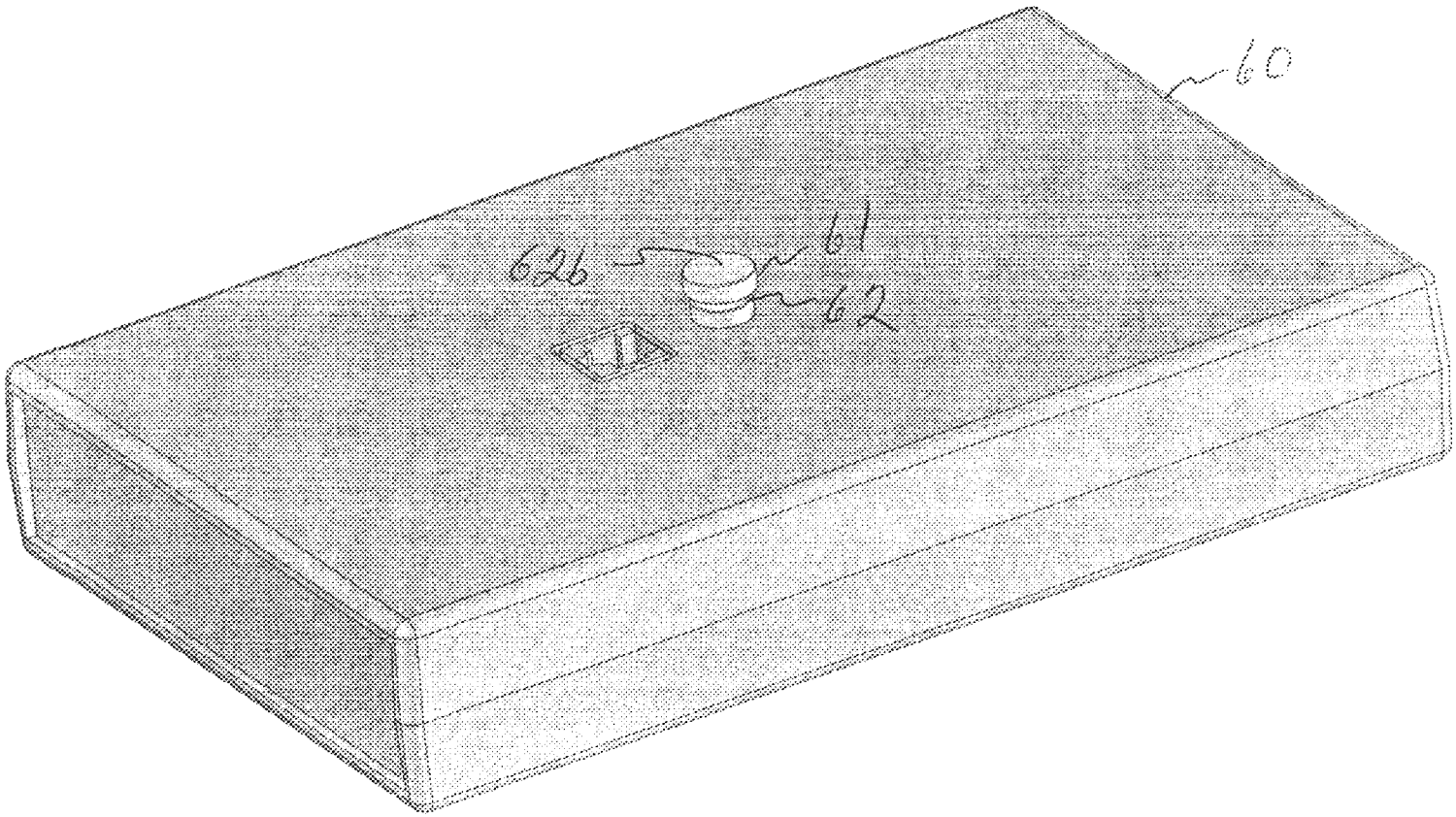
FIG. 6 is a drawing of a wireless LAN access point.

FIGS. 3, 4 and 5 are perspective drawings of different views of the track clip hanger (TCH) assembly 10, of our invention. FIG. 3 is a drawing showing a bottom view of the TCH assembly 10, FIG. 4 is a drawing showing a top view of the TCH assembly 10 and FIG. 5 is another top view of the TCH assembly 10. The bottom and top views are from the perspective of someone standing under a TCH assembly 10 that is attached to a ceiling track. The TCH assembly 10 is formed by a molding process and can be constructed of any strong, easily molded material. In this case the material is a plastic selected for both it tensile and yield strength. Each of the FIGS. 3, 4 & 5 show the first and second TCH body elements, labeled 32 and 33 respectively, which are designed to slidably mate with each other as the assembly is attached to the ceiling track 11. From a different perspective, the act of slidably mating the first and second TCH bodies results in the attachment of the TCH assembly 10 to the ceiling track 11. The first TCH body 32 is designed to receive a clip mounting element 61 that includes a head element **62*b* which is attached via a stem element 62*a* to the top of, for example, a wireless LAN access point 60 as shown in FIG. 6. Once the TCH assembly 10 is attached to the ceiling track 11, the access point 60 can be attached to the bottom of the TCH assembly 10 by simply inserting the clip mounting element 61 into the open end of an access point mount receiver element that will be discussed later with reference to FIGS. 7 and 8**.

Figure 7:
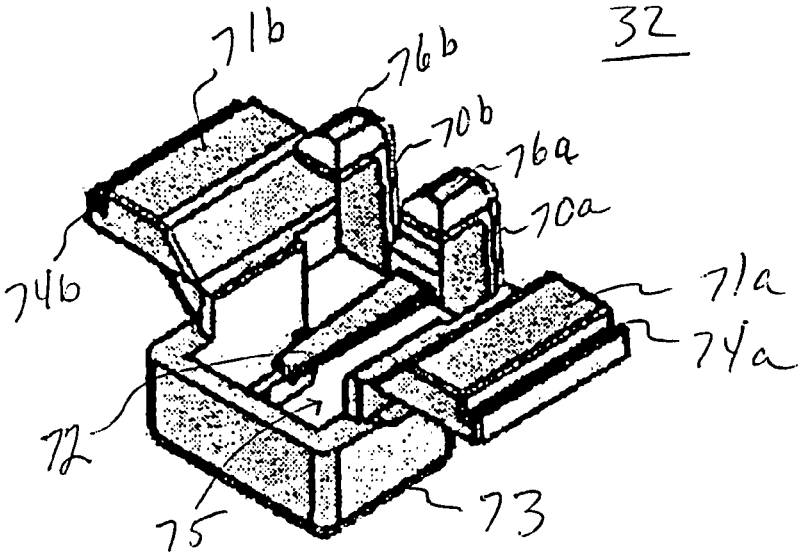
FIG. 7 is a perspective drawing of a top view of a first body element comprising the track clip hanger assembly.

FIG. 7 is a top view of the first TCH body element 32, showing two ceiling channel attachment arms 70*a* and 70*b* hereinafter referred to as simply attachment arms, two TCH assembly body mating elements 71*a* and 71*b*, an access point mount retainer element 72, an access point clip mount receiver element 73 and two TCH body mating channel registration elements 74*a* and 74*b*. Each of the two attachment arms, 70*a* and 70*b*, are connected to the TCH body element 32 at their proximal ends and extend in an essentially straight manner upwards to flanges 76*a* and 76*b* that extend from the distal end of the attachment arms at a ninety degree angle. The bottom surface of each of these flanges rests on the top of a ceiling track horizontal element, supporting the first TCH body element 10 on the ceiling track 11 as previously illustrated with reference to FIG. 1.

The two body mating elements 71*a* and 71*b* and the associated registration channels 74*a* and 74*b* respectively are designed to register the first TCH body element 32 with the second TCH body element 33 during the process of mating the two body elements. The access point clip mount receiver element 73 is open at the top, as indicated by 75 and the associated arrow pointing to the opening, and generally designed to accept the access point clip mounting element 61 of FIG. 6 such that the mounting element head 62*b* is positively seated in the receiver element 73. Although the preferred embodiment of our TCH includes a receiver element 73 that is optimally designed to receive an access point with a particular type of mounting element, the receiver design can be easily modified so that a sign or other object can be attached to the TCH assembly 10.

Figure 8:
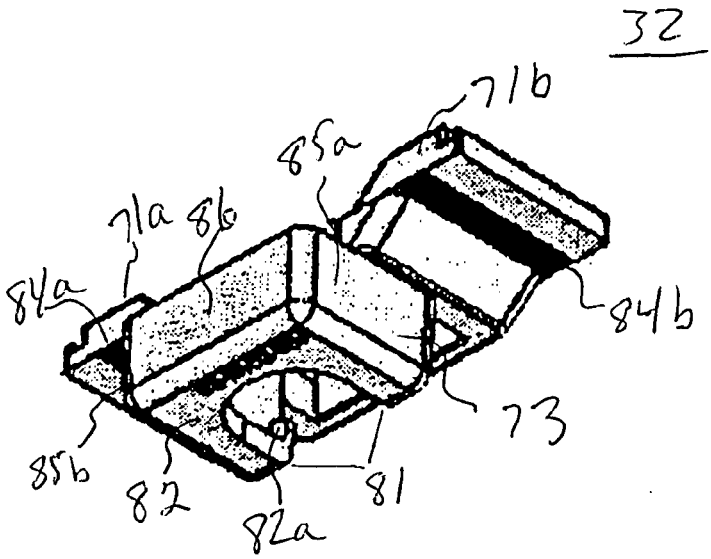
FIG. 8 is a perspective drawing of a bottom view of the first body element comprising the track clip hanger assembly.

FIG. 8 is a bottom view of the first TCH body element 32, showing the first and second TCH assembly body mating elements 71*a* and 71*b* respectively and associated mating interference or ratcheting elements 84*a* and 84*b* respectively and the access point mount receiver 73. The AP mount receiver 73 is comprised of a front opening 81 for receiving access point clip mount element 61 as previously described with reference to FIG. 7, a bottom surface element 82 that includes a semi-circular opening 82*a* that receives the access point mount element stem 62*a*, two side surface elements 85*a* (shown in view) and 85*b* (not shown in view) and a back surface element 86. The AP mount receiver 73 is further includes two receiver lip elements 83*a* and 83*b* (not shown in view). The two TCH body mating interference or ratcheting elements 84*a* and 84*b* are molded into the bottom side of each TCH assembly body mating element 71*a* and 71*b* respectively, and can run the entire length of both mating elements. The function of the two ratcheting elements will be described later in detail with reference to FIG. 9.

Returning now to FIG. 7, once the access point clip mounting element 61 is placed into the receiver element 73, an access point clip mount retainer element 72 presses downward on the top of the mounting element head 62*b* and applies downward pressure to the top of the head element to positively hold the access point 60 in the receiver 73. Thus both the lip elements 83*a* and 83*b* describe previously in FIG. 8 and the retainer 72 shown in FIG. 7 operate to positively hold the access point mounting element 61 and therefore the access point 60 positively in place.

Turning now to FIG. 9, which is a top view of the second TCH body element 33. TCH body element 33 is comprised of two TCH body mating elements 92*a* and 92*b*, a body mating element connecting member 94, two attachment arms 93*a* and 93*b* and two attachment arm flanges 96*a* and 96*b*. Each one of the two TCH body mating elements 92*a* and 92*b* includes a TCH body mating interference or ratcheting element 91*a* and 91*b* respectively, which is preferably molded into a top surface of each body mating element and functions to provide a friction or ratcheting fit between the first and second TCH body elements 32 and 33. Further, each one of the two TCH body mating elements 92*a* and 92*b* is comprised of a body mating channel registration element 95*a* and 95*b* respectively, which function to correctly position the first and second TCH body elements 32 and 33 during the mating process. Each of the two attachment arms 93*a* and 93*b* are connected at their proximal ends to one of the body mating elements and extend upward in a generally straight manner to a distal end which terminates in attachment arm flanges 96*a* and 96*b* that are arranged at a ninety degree angle to the attachment arm elements. The bottom surfaces of the two attachment arm flanges rest on the top of the horizontal surface of a ceiling track, as illustrated earlier with reference to FIG. 1, such that when the first and second TCH body elements are in the mated position the four flanges 76*a* and 76*b* of FIGS. 7 and 96*a* and 96*b* of FIG. 9 firmly hold the TCH assembly 10 to the ceiling track.

When the TCH body elements 32 and 33 are in the mated position, the interference elements 84*a* and 84*b* molded into the first body element 32 are at least partially in contact with the interference elements 91*a* and 91*b* molded into the second body element 33 to form a frictional or ratcheting type relationship or interface fit that serves to prevent the first and second TCH body elements 32 and 33 from separating or un-mating once they are in a mated position. A further advantage of the manner in which the TCH body elements slidably mate with each other is that the assembly can be attached to ceiling tracks of varying widths.

Figure 11:
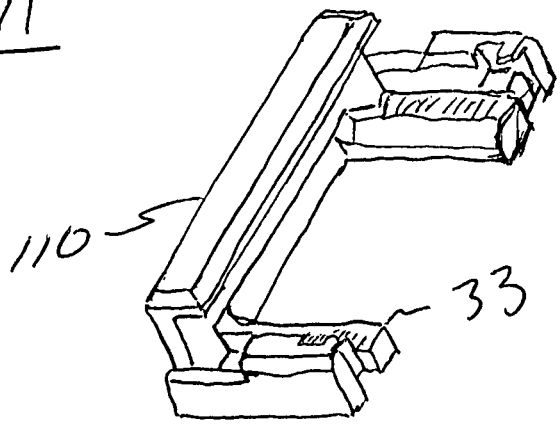
FIG. 11 is a perspective drawing of the second track clip hanger body element with a single ceiling track attachment arm.
Figure 12:
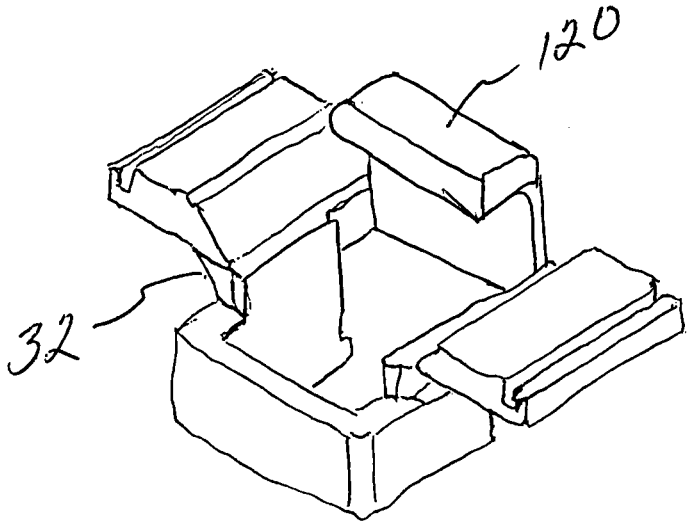
FIG. 12 is a perspective drawing of the first track clip hanger body element with a single ceiling track attachment arm.

In an alternative embodiment of our invention, each of the TCH body elements 33 and 32 described with reference to FIG. 7 and FIG. 9 respectively are modified to only include a single ceiling track attachment arm. FIG. 11 illustrates TCH body element 33 with a single ceiling track attachment arm 110 which can replace the two ceiling track attachment arms 70*a* and 70*b* showing in FIG. 7. Similarly, FIG. 12 illustrates TCH body element 32 with a single ceiling track attachment arm 120 which can replace the two ceiling track attachment arms 93*a* and 93*b* shown in FIG. 9. As can be seen in each of the FIGS. 11 and 12, the ceiling track attachment arms 110 and 120 are more substantial than the ceiling track attachment arms 70*a* and 70*b* and 93*a* and 93*b*. Being more substantial permits a greater weight to be attached to the TCH assembly 10 once it is attached to a ceiling track.

In yet another alternative embodiment of our invention, the access point mount receiver element 73 described with reference to FIG. 7 is replaced a receiver element 100 shown with reference to FIG. 10. The receiver element 100 is rectangular in shape and in this case entirely solid, although this is not necessary. The receiver element includes a thru hole 112 that can be threaded or not. In the event that the thru hole is not threaded, a metallic, threaded sleeve, not shown, can be inserted into the thru hole and attached to the receiver in such a manner that it can not be easily removed. An adhesive agent can be used to attach the sleeve to the thru hole or the dimensions of the thru hole can be specified such that a certain amount of pressure needs to be used to press the sleeve into the thru hole, such as with a pressed fit arrangement.

Figure 13:
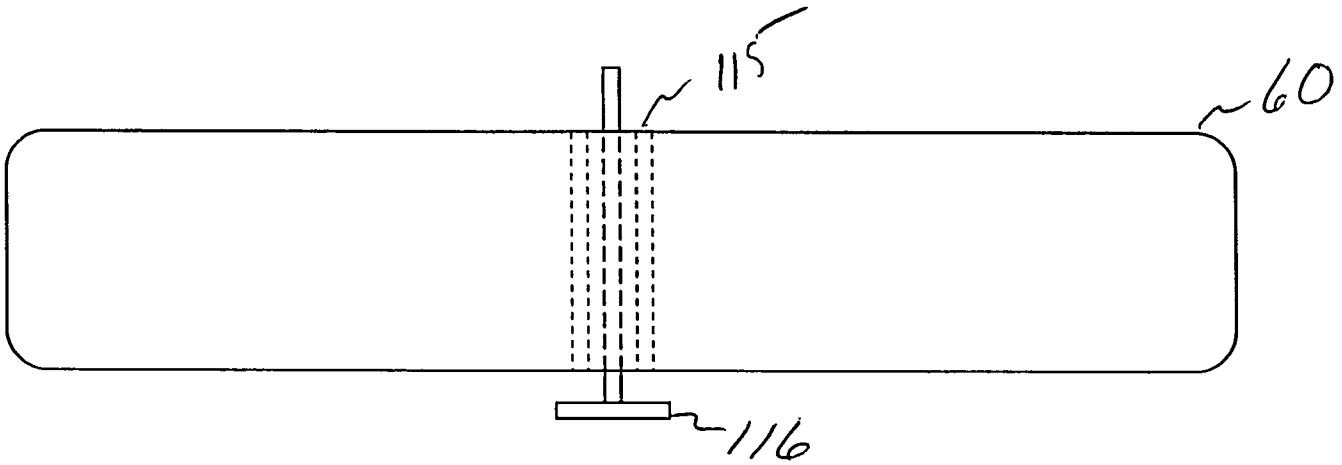
FIG. 13 is a side view of the wireless LAN access point showing a through sleeve arrangement.

In another embodiment of our invention, the mounting element 61 described with reference to FIG. 6 can be replaced by a screw that passes through the access point 60. FIG. 13 is a side view of the access point 60 of FIG. 6 showing a thru sleeve arrangement 115 through which is passed a screw 116. Once the alternative embodiment of our TCH assembly 10 described with reference to FIG. 10 is attached to a ceiling track, the access point 60 can be mounted to the TCH assembly by simply passing the screw 116 through the sleeve 115 to engage the threaded thru hole 112 of FIG. 10 and turned to secure the access point to the TCH assembly. Although we have described the screw 116 as not being permanently associated with the through sleeve 115, the screw 116 can be permanently associated with or captive by the through sleeve 115.

Although, we describe various aspects of the preferred embodiment of our inventive TCH assembly in a particular way, it should be understood that this description is meant only to as a guide to those who wish to practice this invention and not as limitations to the invention. So, for instance, although we describe the attachment arm elements as being attached at their proximate ends to TCH body mating elements and extending in a generally straight manner to a flange at their distal ends, the attachment arm can be designed such that the portion of the arm between its proximate and distal ends is not generally straight.

The forgoing description, for purposes of explanation, used specific nomenclature to provide a thorough understanding of the invention. However, it will be apparent to one skilled in the art that specific details are not required in order to practice the invention. Thus, the forgoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

We claim:

1. A hanger for suspending an object from a ceiling track, the hanger comprising:

a first body having a first arm and a first mating element, the first body for disposing adjacent one edge of the ceiling track, the first arm for engaging the ceiling track on the one edge thereof;

a second body having a second arm and a second mating element, the second body for disposing adjacent an opposite edge of the ceiling track, the second mating element slidably mating to the first mating element and affixing the first and second bodies together, the second arm for engaging the ceiling track on the opposite edge thereof; and a mount disposed on the second body and adapted to hold the object suspended therefrom, wherein the first or second arm comprises a plurality of flanges depending inward for engaging the edge of the ceiling track, and the first and second mating elements define ratchets maintaining the first and second bodies affixed together;

such that when the first body and the second body are mated around the ceiling track the first arm and the second arm engage the ceiling track on opposing edges.

2. The hanger of claim 1, wherein the first and second bodies affix together with an interference fit between the first and second mating elements slidably mated together.

3. The hanger of claim 1, wherein the mount comprises a lip defining a slot with an open side, the slot receiving a fastener from which the object suspends, the lip holding the fastener on the mount.

4. The hanger of claim 3, wherein the second body comprises a retainer holding the fastener in the slot against the lip.

5. The hanger of claim 1, wherein the mount defines a threaded opening receiving a fastener from which the object suspends.

6. The hanger of claim 1, wherein the mount comprises a captive screw disposed on the second body.

7. An assembly for suspending an object from a ceiling track, the assembly comprising:

a first clip having a first arm and a first mating element, the first clip for disposing adjacent the ceiling track, the first arm for engaging the ceiling track on one edge thereof; and a second clip having a second arm and a second mating element, the second clip for disposing adjacent the ceiling track, the second mating element slidably mating to the first mating element and affixing the first and second clips together, the second arm for engaging the ceiling track on an opposite edge thereof;

a body having a fastener attached thereto; and a mount disposed on the second clip, the mount attaching to the fastener and holding the body suspended therefrom, the mount comprising a lip defining a slot with an open side, the slot receiving the fastener from which the object suspends, the lip holding the fastener on the mount, wherein the first or second arm comprises a plurality of flanges depending inward for engaging the edge of the ceiling track;

such that when the first and second clips are affixed together the first arm and the second arm engage the ceiling track on opposing edges.

8. The assembly of claim 7, wherein the first and second clips affix together with an interference fit between the first and second mating elements slidably mated together.

9. The assembly of claim 7, wherein the first and second mating elements define ratchets maintaining the first and second clips affixed together.

10. The assembly of claim 7, wherein the fastener comprises:

a stem attached to the body and passing through the slot; and a head disposed on the stem and mounting on the lip.

11. The assembly of claim 7, wherein the second clip comprises a retainer holding the fastener in the slot against the lip.

12. The assembly of claim 7, wherein the mount defines a threaded opening receiving the fastener from which the object suspends.

13. The assembly of claim 7, wherein the fastener comprises a captive screw disposed on the mount.

14. The assembly of claim 7, wherein the body comprises an electronic device.

15. The assembly of claim 14, wherein the electronic device comprises an access point.

16. The assembly of claim 7, wherein at least one of the first and second mating elements comprises a register registering the mating of the first and second clips together.

17. A hanger for suspending an object from a ceiling track, the hanger comprising:

a first body having a first arm and a first mating element, the first mating element comprising a pair of first channels defined along opposing sides of the first body, the first body for disposing adjacent one edge of the ceiling track, the first arm for engaging the ceiling track on the one edge thereof;

a second body having a second arm and a second mating element, the second mating element comprising a pair of second channels defined along opposing sides of the second body, the second channels slidably mating with the first channels, the second body for disposing adjacent an opposite edge of the ceiling track, the second mating element slidably mating to the first mating element and affixing the first and second bodies together, the second arm for engaging the ceiling track on the opposite edge thereof; and a mount disposed on the second body and adapted to hold the object suspended therefrom, wherein the mount comprises a lip defining a slot with an open side, the slot receiving a fastener from which the object suspends, the lip holding the fastener on the mount.

18. The hanger of claim 17, wherein the first and second bodies affix together with an interference fit between the first and second mating elements slidably mated together.

19. The hanger of claim 17, wherein the first and second mating elements define ratchets maintaining the first and second bodies affixed together.

20. The hanger of claim 17, wherein the second body comprises a retainer holding the fastener in the slot against the lip.

21. The hanger of claim 17, wherein the mount defines a threaded opening receiving a fastener from which the object suspends.

22. The hanger of claim 17, wherein the mount comprises a captive screw disposed on the second body.

23. An assembly for suspending an object from a ceiling track, the assembly comprising:

a first clip having a first arm and a first mating element, the first mating element comprises a pair of first channels defined along opposing sides of the first clip, the first clip for disposing adjacent the ceiling track, the first arm for engaging the ceiling track on one edge thereof; and a second clip having a second arm and a second mating element, the second mating element comprises a pair of second channels defined along opposing sides of the second clip, the second channels slidably mating with the first channels and affixing the first and second clips together, the second clip for disposing adjacent the ceiling track and for engaging the ceiling track on an opposite edge thereof, the first and second mating elements defining ratchets maintaining the first and second clips affixed together;

a body having a fastener attached thereto; and a mount disposed on the second clip, the mount attaching to the fastener and holding the body suspended therefrom.

24. The assembly of claim 23, wherein the first and second clips affix together with an interference fit between the first and second mating elements slidably mated together.

25. The assembly of claim 23, wherein the mount comprises a lip defining a slot with an open side, the slot receiving the fastener from which the object suspends, the lip holding the fastener on the mount.

26. The assembly of claim 25, wherein the fastener comprises:

a stem attached to the body and passing through the slot; and a head disposed on the stem and mounting on the lip.

27. The assembly of claim 25, wherein the second clip comprises a retainer holding the fastener in the slot against the lip.

28. The assembly of claim 23, wherein the mount defines a threaded opening receiving the fastener from which the object suspends.

29. The assembly of claim 23, wherein the fastener comprises a captive screw disposed on the mount.

30. The assembly of claim 23, wherein the body comprises an electronic device.

31. The assembly of claim 23, wherein the electronic device comprises an access point.

* * * * *